US008336230B2

(12) United States Patent
Crowley et al.

(10) Patent No.: US 8,336,230 B2
(45) Date of Patent: Dec. 25, 2012

(54) ARTICLE OF FOOTWEAR FOR WEIGHT LIFTING

(75) Inventors: Gerald E. Crowley, Beaverton, OR (US); Sean M. McDowell, Portland, OR (US); Sol Sallos, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1283 days.

(21) Appl. No.: 11/566,204

(22) Filed: Dec. 1, 2006

(65) Prior Publication Data

US 2008/0127522 A1 Jun. 5, 2008

(51) Int. Cl.
*A43B 21/00* (2006.01)
*A43B 5/00* (2006.01)
*A43B 7/16* (2006.01)

(52) U.S. Cl. ..... 36/105; 36/81; 36/114

(58) Field of Classification Search ..... 36/105, 36/132, 136, 27, 13, 33, 81
See application file for complete search history.

(56) References Cited

U.S. PATENT DOCUMENTS

| | | | | |
|---|---|---|---|---|
| 2,198,338 A | | 4/1940 | Greider | |
| 2,367,481 A | | 1/1945 | Burger | |
| 4,238,894 A | | 12/1980 | Evans | |
| 4,258,480 A | * | 3/1981 | Famolare, Jr. | 36/91 |
| D259,150 S | | 5/1981 | Cesare et al. | |
| 4,494,322 A | * | 1/1985 | Klagmann | 36/28 |
| D283,173 S | | 4/1986 | Malone | |
| 4,654,982 A | | 4/1987 | Lee | |
| 4,663,865 A | | 5/1987 | Telecemian | |
| 4,739,765 A | | 4/1988 | Sydor et al. | |
| 4,785,557 A | * | 11/1988 | Kelley et al. | 36/32 R |
| 4,811,500 A | | 3/1989 | Maccano | |
| 5,075,984 A | * | 12/1991 | Shiew | 36/113 |
| 5,140,758 A | | 8/1992 | Damien | |
| 5,505,010 A | * | 4/1996 | Fukuoka | 36/3 B |
| 5,765,295 A | | 6/1998 | Srourian et al. | |
| 5,970,630 A | * | 10/1999 | Gallegos | 36/100 |
| 6,041,523 A | | 3/2000 | Deloreia | |
| 6,266,896 B1 | * | 7/2001 | Liu | 36/28 |
| 6,691,360 B2 | | 2/2004 | Mukherjee et al. | |
| 6,843,000 B1 | * | 1/2005 | Park | 36/29 |
| 7,266,912 B2 | * | 9/2007 | Whatley | 36/132 |
| 2007/0119076 A1 | * | 5/2007 | Brewer et al. | 36/30 R |

* cited by examiner

*Primary Examiner* — Khoa Huynh
*Assistant Examiner* — Sharon M Prange
(74) *Attorney, Agent, or Firm* — Plumsea Law Group, LLC

(57) ABSTRACT

An article of footwear for use in weight lifting is disclosed. The article of footwear includes a non-deforming midsole. Also, the article of footwear includes a raised heel and a substantially flat bottom surface. Additionally, the article of footwear includes holes formed along the bottom of the midsole in order to reduce the weight of the article of footwear.

21 Claims, 5 Drawing Sheets

ARTICLE OF FOOTWEAR FOR WEIGHT LIFTING

BACKGROUND OF THE INVENTION

1. Field of the Invention

The present invention relates generally to footwear, and in particular an article of footwear intended for use with weight-lifting.

2. Description of Related Art

Articles of footwear intended for use in weight lifting have been previously disclosed. Malone (U.S. Pat. No. D283,173) is directed at an ornamental design for a body building weight lifting shoe. The Malone design includes a midsole that is sloped along the arch region of the shoe, but flattens at the heel region. Malone does not teach a sloped surface internal to the shoe that would angle the foot and raise the heel significantly.

Some provisions for raising the heel in association with weight lifting moves have also been proposed. Deloreia (U.S. Pat. No. 6,041,523) teaches a weight-training method using a shoe insert to elevate the user's heel while performing weight-training exercises. The wedge-shaped insert is made of a relatively hard rubber or thermoplastic material and is shaped to fit into the heel portion of the user's shoe. Delorieia does not teach a provision for raising the heel that is integral to the article of footwear, but teaches a separate insert that may be used with a general article of footwear.

There is a need in the art for an article of footwear that includes an integrally sloped heel. Furthermore, there is a need for an article of footwear with a substantially non-deforming midsole that may provide additional stability.

SUMMARY OF THE INVENTION

An article of footwear for use in weight lifting is disclosed. In one aspect, the invention provides an article of footwear, comprising: an upper and a midsole that is integrally formed with the upper; the midsole including a raised portion; the raised portion including a top rear portion that is disposed rearward of an inner surface of the upper; and where the midsole is made of a substantially non-deforming material.

In another aspect, the raised portion is made of hard plastic.

In another aspect, the raised portion is angled.

In another aspect, the midsole includes at least one hole formed along a bottom side of the midsole and wherein the weight of the midsole is substantially reduced following the formation of the at least one hole.

In another aspect, the midsole includes a bottom side configured to contact a surface and wherein a majority of the bottom side is substantially flat.

In another aspect, the midsole includes a flattened portion.

In another aspect, the invention provides an article of footwear, comprising: an upper and a midsole that is integrally formed with the upper; the midsole including at least one hole that is formed along a bottom side of the midsole; and where the weight of the midsole is substantially reduced following the formation of the at least one hole.

In another aspect, the midsole includes a raised portion.

In another aspect, the midsole includes a flattened portion.

In another aspect, the midsole includes multiple holes.

In another aspect, the midsole includes a raised portion and wherein the midsole is made of a substantially non-deforming material.

In another aspect, the midsole is made of a hard plastic.

In another aspect, the midsole includes a bottom side configured to contact a surface and wherein a majority of the bottom side is substantially flat.

In another aspect, the invention provides an article of footwear, comprising: an upper and a midsole that is integrally formed with the upper; the midsole including a bottom side configured to contact a surface; and where a majority of the bottom side is substantially flat.

In another aspect, the midsole includes a raised portion and wherein the midsole is made of a substantially non-deforming material.

In another aspect, the midsole includes a flattened portion.

In another aspect, the midsole includes multiple holes.

In another aspect, the midsole includes six holes.

In another aspect, the midsole includes at least one hole formed along a bottom side of the midsole and wherein the weight of the midsole is substantially reduced following the formation of the at least one hole.

In another aspect, the midsole is made of hard plastic.

In another aspect, the invention provides an article of footwear, comprising: an upper and a midsole that is integrally formed with the upper; the midsole including a raised portion and a bottom surface that is substantially flat; the midsole being made of a substantially non-deforming material; the midsole including at least one hole that is formed along a bottom side of the midsole; and where the weight of the midsole is substantially reduced following the formation of the at least one hole.

In another aspect, the upper includes two straps.

In another aspect, the midsole includes ridges.

In another aspect, the raised portion is disposed at an angle.

In another aspect, the non-deforming material is hard plastic.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
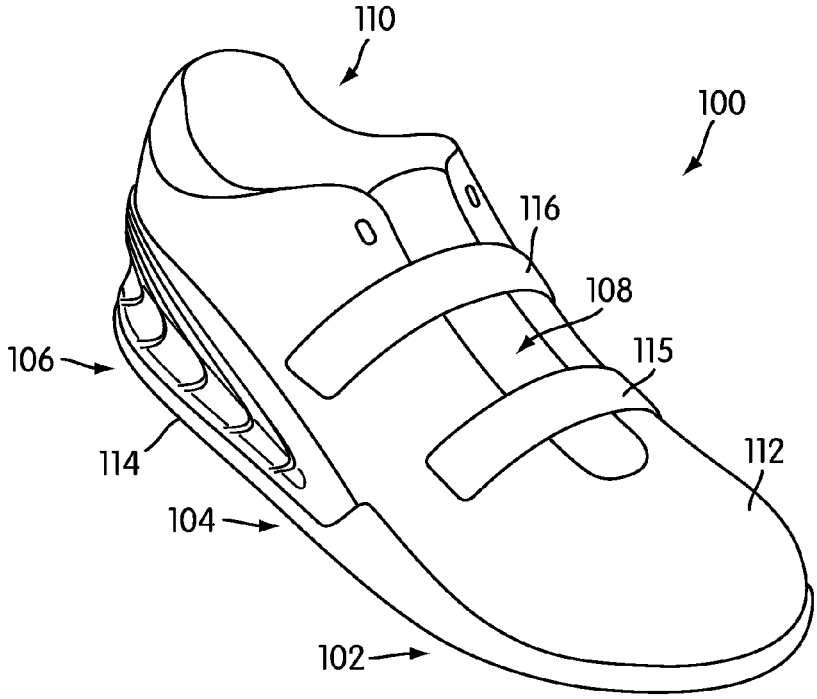
FIG. 1 is an isometric view of a preferred embodiment of an article of footwear.

FIG. 1 is an isometric view of a preferred embodiment of article of footwear 100. In a preferred embodiment, article of footwear 100 may be a weight lifting shoe. For clarity, the following detailed description discusses a preferred embodiment, however, it should be kept in mind that the present invention could also take the form of any other kind of footwear including, for example, athletic shoes, boots, extended heel shoes, as well as other kinds of footwear.

Generally, article of footwear 100 may be divided into multiple portions. In this embodiment, article of footwear 100 may include forefoot portion 102, arch portion 104, and heel portion 106. Additionally, article of footwear 100 may include instep portion 108 as well as ankle portion 110. Furthermore, article of footwear 100 preferably includes upper 112 and midsole 114. Upper 112 may be made of any material that is both durable and flexible. By using durable and flexible materials, upper 112 will be able to accommodate a user's foot in a comfortable fashion, but will likewise provide the necessary support to maintain the proper function of article of footwear 100. Materials of this type, from which upper 112 may be constructed, include, but are not limited to, natural fabrics, synthetic fabrics, leather and other materials that are used in the construction of shoe uppers.

Preferably, article of footwear 100 includes provisions for adjustably fastening upper 112 to a wearer's foot. In some embodiments, article of footwear 100 may include first strap 115 and second strap 116. Straps 115 and 116 may tighten upper 112 to a wearer's foot at instep portion 108 of article of footwear 100. Although two straps are shown in this preferred embodiment, in other embodiments any number of straps may be used. In a preferred embodiment, straps 115 and 116 may comprise a hook and loop fastening system, such as Velcro©, that facilitates ease of use. It should be understood, however, that other embodiments may include different kinds of adjustable fastening systems. Generally, any kind of fastening system may be used. Examples of fastening systems include, but are not limited to, laces, zippers, snapping devices, as well as other kinds of fastening systems.

Typically, a midsole is provided as part of an article of footwear to provide additional support along the base of the footwear. Midsoles may function to provide traction and impact resistance, as well as general support for the foot. In the case of weight lifting, the article of footwear, and in particular the midsole, may include additional provisions that provide the necessary stability to perform various weight lifting moves.

In some embodiments, midsole 114 may be made of a hard material. In particular, the material may be substantially non-deforming. In some embodiments, the material may be a hard plastic. In other embodiments, various thermoplastics may be used. In a preferred embodiment, the material may be TPU or PEBAX (0.7233). By using one of the materials disclosed here, midsole 114 may be prevented from substantially deforming during a weight lifting maneuver and, by doing this, provide the necessary stability to the weight lifter.

Often, a weight lifter may use various methods, such as boards or other slightly raised platforms, to help in performing weight lifting exercises. Examples include placing the heels along boards in order to elevate the heels in a manner that helps to reduce the possibility of hyperextending the muscles of the calf, including the gastrocnemius and the soleus, and the Achilles tendon. By placing the wearer's heel, calf and knee in proper position, article of footwear 100 can help prevent injury during some exercises. Preferably, midsole 114 includes provisions for facilitating the proper position of raising the heels.

Figure 2:
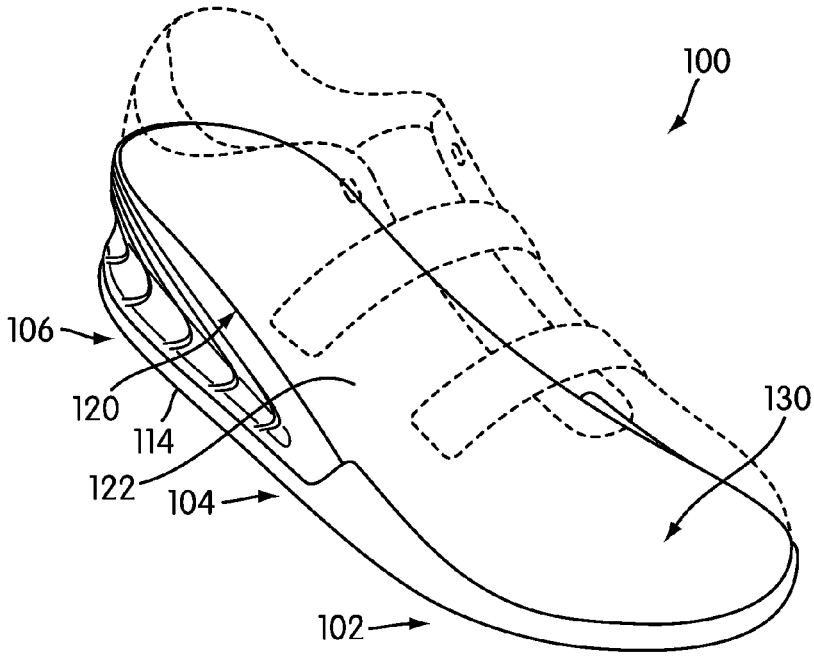
FIG. 2 is an isometric view of a preferred embodiment of an article of footwear.
Figure 3:
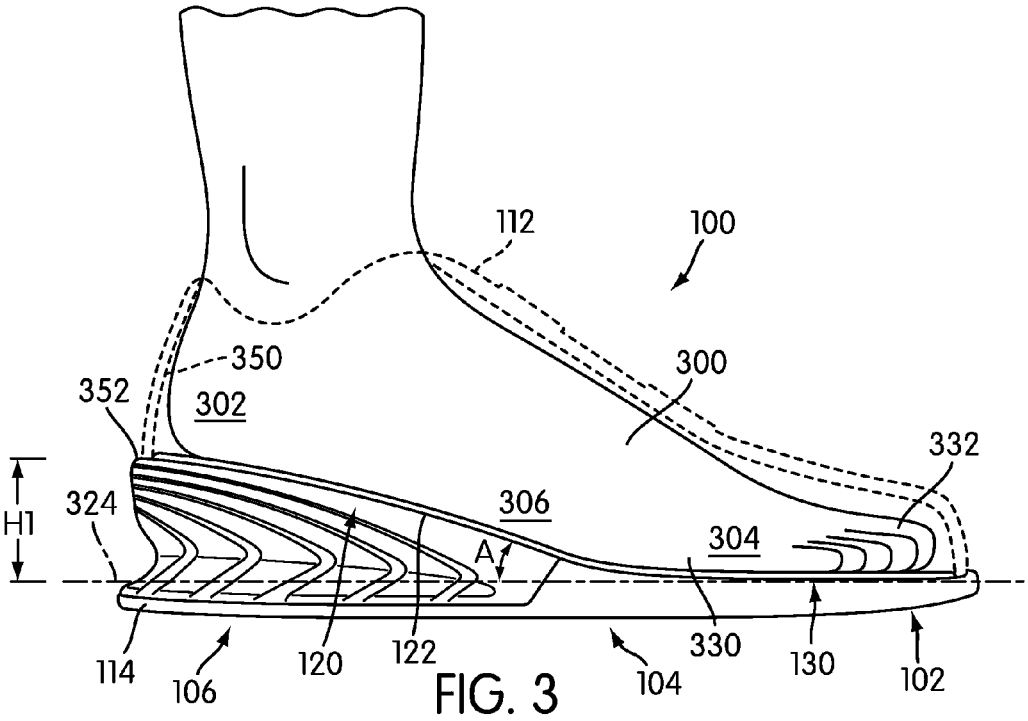
FIG. 3 is a side view of a preferred embodiment of an article of footwear.

Referring to FIGS. 1-3, midsole 114 includes raised portion 120. In some embodiments, raised portion 120 may extend from arch portion 104 to heel portion 106. In particular, raised portion 120 may include sloped surface 122. In this embodiment, sloped surface 122 may be disposed at an angle A with respect to horizontal level 324 of forefoot 304. Horizontal level 324 is a horizontal plane that is disposed just under forefoot 304. Angle A may take on any value in the range 10 degrees to 45 degrees. In a preferred embodiment, angle A may have a value between 20 degrees and 30 degrees.

Preferably, midsole 114 may be integrally formed with upper 112, and in particular, inner surface 350 of upper 112 may be fixed directly to midsole 114. Additionally, top rear portion 352 of midsole 114 may extend rearward of inner surface 350 of upper 112. This integral arrangement preferably increases the stability of article of footwear 100.

In some embodiments, insole 399 may be associated with midsole 114 and upper 112. Generally, insole 399 may be made of a lightweight material that is disposed between foot 300 and midsole 114. Other embodiments may not include an insole.

In some embodiments, midsole 114 may include flattened portion 130, associated with forefoot portion 102 of article of footwear 100. Flattened portion 130 may be substantially parallel with horizontal level 324. In a preferred embodiment, flattened portion 130 is formed continuously with raised portion 120.

The position of foot 300 within upper 112 is illustrated in FIG. 3. In this embodiment, foot 300 is disposed against midsole 114, and within upper 112. In particular, heel 302 of foot 300 is preferably disposed along raised portion 120. Arch 306 of foot 300 may also be disposed along raised portion 120.

Using this configuration, heel 302 is preferably elevated above horizontal level 324 of forefoot 304, which facilitates the proper positioning of heel 302 during weight lifting moves. In this embodiment, heel 302 may be elevated by a height H1 over forefoot 304. In some embodiments, the H1 may take a value in the range 10-26 mm. In a preferred embodiment, height H1 is approximately 22 mm. This arrangement preferably eliminates the need for a weight lifter to use boards or other devices for raising their heels during weight lifting moves. Article of footwear 100 also provides additional advantages over other methods that may be used to raise a weightlifter's heel. Integral elevating devices, such as raised heel 302 of article of footwear 100, are more stable than other elevating devices, such as boards or additional inserts used to elevate the heel. In particular, integral elevating devices may be associated with less risk of slipping, sliding or misalignment, as may occur with boards or additional inserts.

In some embodiments, flattened portion 130 may be associated with ball of foot 330 and toes 332 of foot 300. Ball of foot 330 and toes 332 may be oriented substantially parallel to horizontal level 324. This configuration preferably provides stability to foot 300. In particular, this configuration preferably eliminates the tendency of heel 302 to slide down raised portion 120 as ball of foot 330 is planted substantially flat against flattened portion 130 of midsole 114.

Preferably, midsole 114 includes provisions for increasing the stability of article of footwear 100. In some embodiments, midsole 114 may include a wide base. Also, midsole 114 may include a generally flattened bottom surface. In some embodiments, midsole 114 may include a bottom surface configured to create traction with a ground surface.

Figure 4:
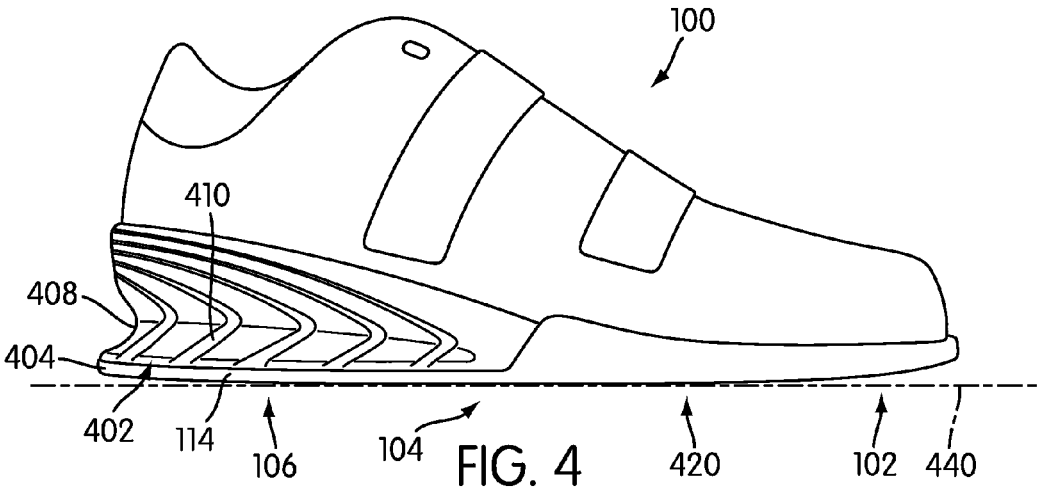
FIG. 4 is a side view of a preferred embodiment of an article of footwear.

Referring to FIG. 4, midsole 114 preferably includes base portion 402 associated with heel portion 106. In this embodiment, base portion 402 is generally an extension of midsole 114. In other words, base portion 402 is preferably formed integrally and, in some cases, simultaneously with midsole 114, such as during a molding process that may be used to form midsole 114. In a preferred embodiment, base portion 402 includes lip portion 404. Lip portion 404 may project outwards, below recessed portion 408. Using this configuration, base portion 402 preferably provides a wide base for midsole 114, thus adding to the overall stability of article of footwear 100.

Generally, the geometry of midsole 114 may be flat along bottom side 420. Preferably, bottom side 420 is substantially parallel to horizontal plane 440. Horizontal plane 440 is preferably coincident with the ground surface. In many articles of footwear, the bottom of the footwear may be slightly curved to conform to the contours of the foot. One feature of article of footwear 100 is this flattened geometry of the bottom of the midsole. Because weight lifters require a sturdy base to perform weight lifting moves, there should be no room for rocking or slight tilting movements at the bottom of article of footwear 100 due to shifts in weight and position.

In some embodiments, bottom side 420 may be flat along heel portion 106 and arch portion 104 only. In a preferred embodiment, bottom side 420 may be slightly curved along forefoot portion 102. This feature may facilitate walking motions using article of footwear 100, while still maintaining a flattened geometry along a substantial majority of midsole 114 that provides a sturdy base for the weight lifter.

In some embodiments, midsole 114 may include ridges 410. Ridges 410 may be configured to reinforce midsole 114 at recessed portion 408. In other embodiments, ridges 410 may be used for decorative purposes. In still other embodiments, ridges 410 may be absent or modified in shape and size.

Often, non-deforming materials are considerably more heavy than deformable materials. Article of footwear 100 includes midsole 114 that is preferably constructed of a non-deforming material, such as hard plastic, which may tend to weigh significantly more than traditional midsoles that may be made of rubber or lightweight plastics. Preferably, midsole 114 includes provisions for reducing the weight of midsole 114. By doing this the overall weight of article of footwear 100 may be reduced without compromising the structural integrity of article of footwear 100.

Figure 5:
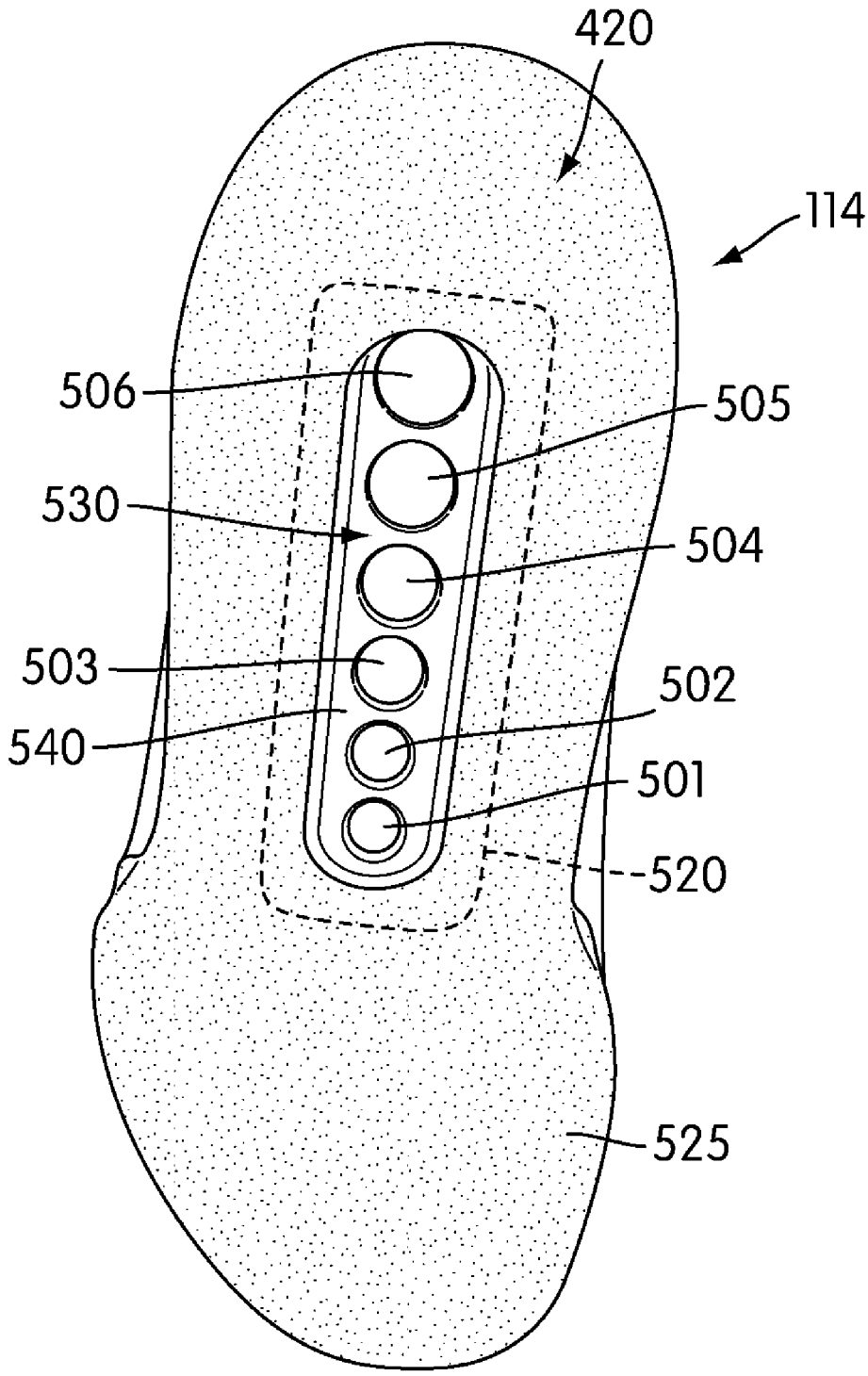
FIG. 5 is a plan view of a preferred embodiment of a midsole.

Referring to FIG. 5, midsole 114 preferably includes a plurality of holes along bottom side 420. In this embodiment, midsole 114 includes first hole 501, second hole 502, third hole 503, fourth hole 504, fifth hole 505 and sixth hole 506. Midsole 114 may also include central cavity 520, illustrated here in phantom. Preferably, central cavity 520 is disposed within midsole 114 and in fluid communication with bottom side 420 through holes 501-506.

Central cavity 520 and holes 501-506 may be any size or shape as long as the structural integrity of midsole 114 is not compromised. In some embodiments, central cavity 520 may be rectangular, while holes 501-506 may be circular. In some embodiments, central cavity 520 and holes 501-506 may have irregular geometries. Preferably, central cavity 520 and holes 501-506 are large enough to substantially reduce the weight of midsole 114.

Central cavity 520 and holes 501-506 may be formed by a variety of processes. In some embodiments, central cavity 520 and holes 501-506 may be formed by drilling. In other embodiments, central cavity 520 and holes 501-506 may be removed from midsole 114 using a method other than drilling. In still other embodiments, central cavity 520 and holes 501-506 may be created during the original molding of midsole 114.

In some embodiments, midsole 114 may be associated with outsole 525. Preferably outsole 525 may be associated with bottom side 420 of midsole 114. Outsole 525 preferably provides traction between midsole 114 and the ground. In a preferred embodiment, outsole 525 may be made of a high abrasion rubber.

As seen in FIG. 5, outsole 525 preferably includes cut-out 530. Central cutout 530 may be disposed along the region of midsole 114 associated with holes 501-506. Given this arrangement, first region 540 of midsole 114 may be exposed. This configuration may provide an aesthetic effect for article of footwear 100, as well as preventing the possibility of ruptures through outsole 525 along holes 501-506, which are areas where outsole 525 would be venerable to puncturing if it were covering holes 501-506.

Figure 6:
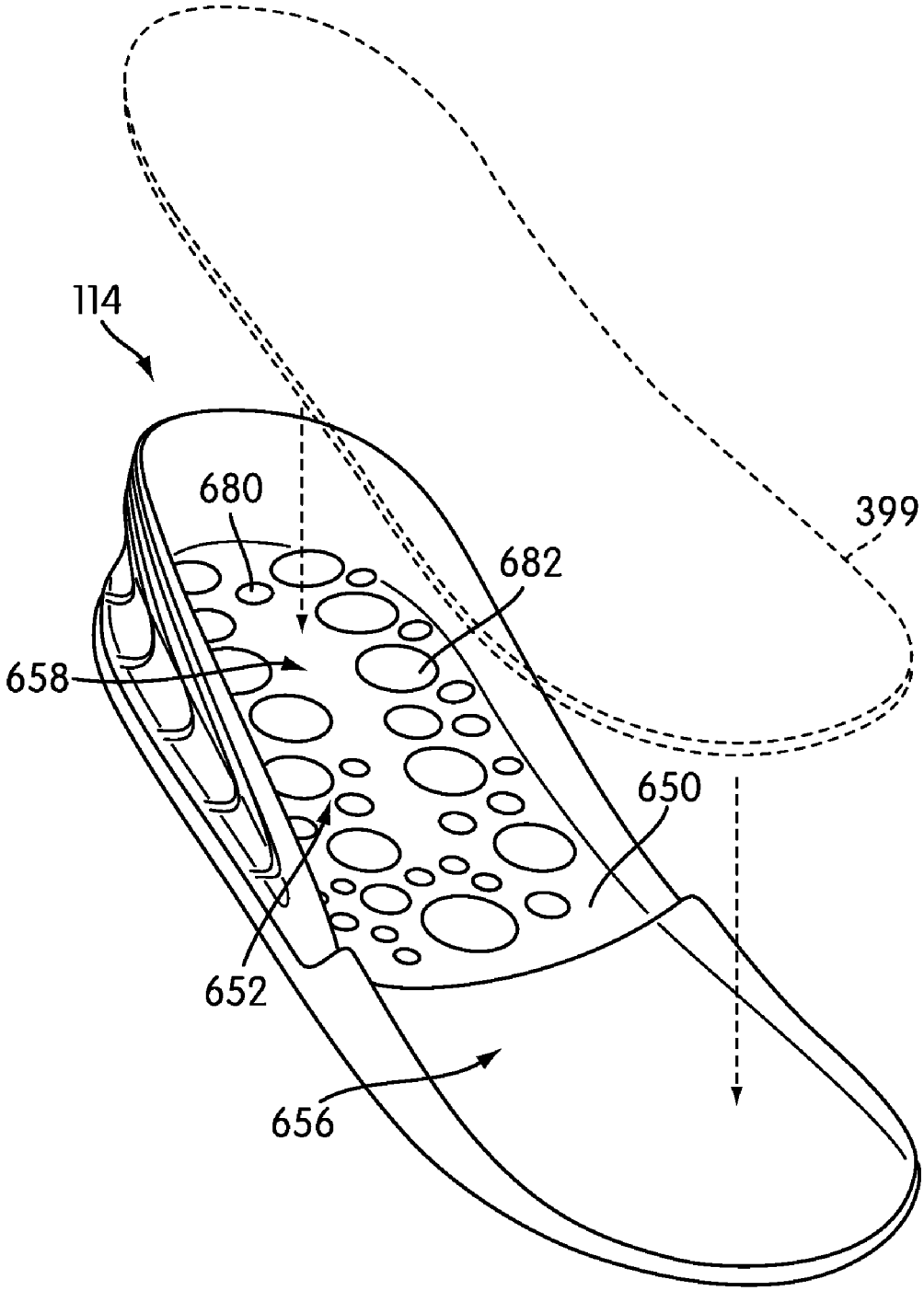
FIG. 6 is a schematic view of a preferred embodiment of an article of footwear with a solid midsole.

In addition to holes 501-506 distributed on bottom side 420, midsole 114 may further include holes distributed on inner surface 650 of midsole 114, as seen in FIG. 6. Preferably, inner surface 650 may be disposed just below insole 399. In this embodiment, inner surface 650 may include surface holes 652. In particular, surface holes 652 may be disposed from heel region 658 to forefoot region 656.

Generally, the diameter and depth of each hole comprising surface holes 652 may vary. In this embodiment, surface holes 652 preferably include small holes 680 and large holes 682. Small holes 680 may be disposed in between large holes 682. Preferably, surface holes 652 may be deeper along heel region 658, as midsole 114 is higher along this region.

This embodiment is only meant to illustrate one configuration for surface holes 652. In other embodiments, the number of holes, as well as their general configuration along inner surface 650, may vary. Some embodiments may include only large holes 682, while others may include only small holes 680. Still some embodiments may include holes that are oriented in specific patterns, including ring-like patterns, grid-like patterns, as well as other kinds of patterns.

Figure 7:
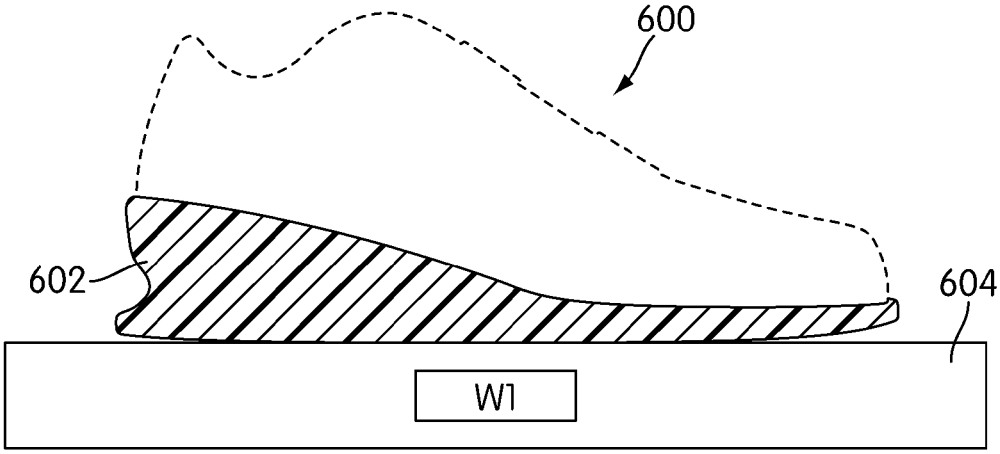
FIG. 7 is a schematic view of a preferred embodiment of an article of footwear with a solid midsole.
Figure 8:
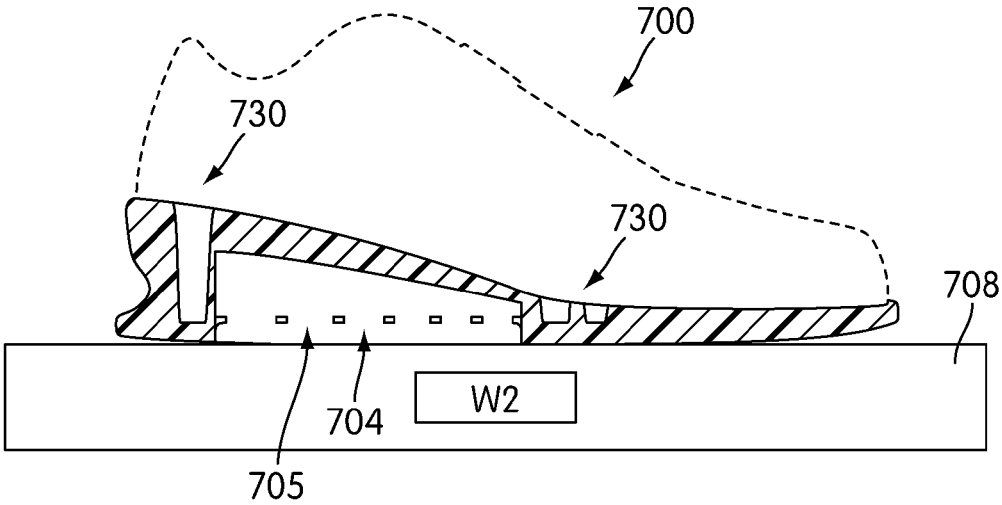
FIG. 8 is a schematic view of a preferred embodiment of an article of footwear with a perforated midsole.

Using this configuration, the weight of article of footwear 100 may be substantially reduced. FIGS. 7 and 8 illustrate one embodiment of this weight reduction. Article of footwear 600 includes solid midsole 602, without any holes or cavities. Article of footwear 600 has a first weight of W1 in this embodiment. Article of footwear 700 includes midsole 702, with holes 704 and central cavity 705 as well as surface holes 730. Article of footwear 700 has a second weight of W2 in this embodiment. In a preferred embodiment, second weight W2 is about half the value of first weight W1. In particular, second weight W2 may have a value of approximately 22 ounces. It should be understood that the weights of an article of footwear before and after material has been removed from the midsole may vary. It is clear from this embodiment that the weight of midsole 702 has been significantly reduced due to holes 704 and central cavity 705.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear, comprising:

an upper and a midsole that is integrally formed with the upper;

the midsole including a raised portion;

the raised portion extending from an arch portion of the midsole through a heel portion of the midsole, a top surface of the raised portion having a substantially constant angle with respect to a bottom side of the midsole; and wherein the midsole is made of a substantially non-deforming material, and the midsole includes multiple holes formed in the bottom side of the midsole, each of the multiple holes being surrounded laterally by midsole material; and the multiple holes are located within a recessed cavity in the bottom side of the midsole, the recessed cavity being surrounded by midsole material.

2. The article of footwear according to claim 1, wherein the raised portion is made of hard plastic.

3. The article of footwear according to claim 1, wherein the recessed cavity extends from a heel portion of the shoe through an arch portion of the shoe.

4. The article of footwear according to claim 1, wherein the midsole includes an inner side configured to contact the upper, the inner side being disposed opposite the bottom side;

wherein a majority of the bottom side is substantially flat; and wherein the midsole includes at least one hole that is open in the inner side, the at least one hole open in the inner side having a vertical height that is less than a vertical height of the midsole where the at least one hole is located.

5. The article of footwear according to claim 4, wherein the midsole includes multiple holes open in the inner side, each hole of the multiple holes being surrounded laterally by midsole material throughout substantially their entire vertical height.

6. The article of footwear according to claim 1, wherein the midsole includes a flattened portion.

7. The article of footwear according to claim 4, wherein the midsole includes multiple holes open in the inner side, wherein each hole in a first group of multiple holes open in the inner side has a first diameter, and each hole in a second group of multiple holes open in the inner side has a second diameter, the second diameter being different from the first diameter.

8. The article of footwear according to claim 7, wherein the first group of multiple holes open in the inner side is interspersed between the second group of multiple holes open in the inner side.

9. The article of footwear according to claim 7, wherein each hole in the first group of multiple holes open in the inner side is adjacent to at least hole in the second group of multiple holes open in the inner side.

10. The article of footwear according to claim 1, wherein the weight of the midsole is substantially reduced by about half following the formation of the holes as compared to the weight of the midsole without the holes.

11. The article of footwear according to claim 1, wherein the top surface of the raised portion is disposed at an angle of between about 20 degrees and about 30 degrees with respect to the bottom side of the midsole.

12. The article of footwear according to claim 1, wherein a lip portion of the midsole extends outwards laterally beyond an inner surface of the upper.

13. The article of footwear according to claim 1, wherein the multiple holes formed in the bottom side of the midsole each have a vertical height that is less than a vertical height of the midsole where the at least one hole is formed.

14. An article of footwear, comprising:

an upper and a midsole that is integrally formed with the upper; the midsole including:

a raised portion extending from an arch portion of the midsole through a heel portion of the midsole, a top surface of the raised portion being disposed at a substantially constant angle with respect to a bottom side of the midsole;

an inner side configured to contact the upper, the inner side including multiple holes open therein, each hole of the multiple holes in the inner side having a vertical height that is less than a vertical height of the midsole where each hole is located, all of the multiple holes open in the inner side being surrounded laterally by midsole material throughout substantially their entire vertical height;

the bottom side being substantially flat; and multiple holes that are formed in the bottom side of the midsole, each of the multiple holes being surrounded laterally by midsole material, and the multiple holes are located within a recessed cavity in the bottom side of the midsole, the recessed cavity being surrounded by midsole material;

the midsole being made of a substantially non-deforming material; and wherein the weight of the midsole is substantially reduced following the formation of the holes.

15. The article of footwear according to claim 14, wherein the upper includes two straps.

16. The article of footwear according to claim 14, wherein the midsole includes ridges.

17. The article of footwear according to claim 14, wherein the recessed cavity extends from a heel portion of the shoe through an arch portion of the shoe.

18. The article of footwear according to claim 14, wherein the non-deforming material is hard plastic.

19. The article of footwear according to claim 14, wherein each hole in a first group of multiple holes open in the inner side has a first diameter, and each hole in a second group of multiple holes open in the inner side has a second diameter, the second diameter being different from the first diameter.

20. The article of footwear according to claim 19, wherein the first group of multiple holes open in the inner side is interspersed between the second group of multiple holes open in the inner side 21. The article of footwear according to claim 19, wherein each hole in the first group of multiple holes open in the inner side is adjacent to at least hole in the second group of multiple holes open in the inner side.

* * * * *